US009480930B2

(12) United States Patent
Bergmann

(10) Patent No.: US 9,480,930 B2
(45) Date of Patent: Nov. 1, 2016

(54) MODULAR BALLAST FOR BALANCING NEUTRALLY BUOYANT AMUSEMENT BALLOONS

(71) Applicant: David Bergmann, St. Paul, MN (US)

(72) Inventor: David Bergmann, St. Paul, MN (US)

( * ) Notice: Subject to any disclaimer, the term of this patent is extended or adjusted under 35 U.S.C. 154(b) by 0 days.

(21) Appl. No.: 13/715,787

(22) Filed: Dec. 14, 2012

(65) Prior Publication Data

US 2013/0157540 A1 Jun. 20, 2013

Related U.S. Application Data

(60) Provisional application No. 61/576,993, filed on Dec. 17, 2011.

(51) Int. Cl.
*A63H 33/00* (2006.01)
*A63H 27/10* (2006.01)

(52) U.S. Cl.
CPC ..... *A63H 27/10* (2013.01); *A63H 2027/1008* (2013.01)

(58) Field of Classification Search
CPC ..... A63H 27/10
USPC ..... 446/220–226; 428/40.1, 40.9, 41.1, 428/42.2, 42.3, 43; 244/93
See application file for complete search history.

(56) References Cited

U.S. PATENT DOCUMENTS

| | | | | |
|---|---|---|---|---|
| 2,029,132 | A * | 1/1936 | Skelton | 301/5.21 |
| 3,314,529 | A * | 4/1967 | Glowiak | B42F 17/00 206/447 |
| 3,960,409 | A * | 6/1976 | Songer | 301/5.21 |
| 4,307,537 | A * | 12/1981 | Bergmann | 446/222 |
| 4,547,167 | A * | 10/1985 | Bergmann | 446/220 |
| 5,199,667 | A * | 4/1993 | Fujii | 244/93 |
| 5,893,790 | A * | 4/1999 | Montgomery | 446/220 |
| 6,286,906 | B1 * | 9/2001 | Nagashima et al. | 301/5.21 |
| 6,364,421 | B1 * | 4/2002 | Pursley | 301/5.21 |
| 6,413,626 | B1 * | 7/2002 | Wollner | 428/317.3 |
| 6,435,935 | B1 * | 8/2002 | Komaba | 446/220 |
| 6,659,567 | B2 * | 12/2003 | Yamaguchi | 301/5.21 |
| 6,803,084 | B1 * | 10/2004 | Do et al. | 428/40.1 |
| 7,044,561 | B2 * | 5/2006 | Petchel et al. | 301/5.21 |
| 7,459,193 | B2 * | 12/2008 | Utz | 428/40.1 |
| 2006/0292959 | A1 * | 12/2006 | Greenwald et al. | 446/220 |
| 2010/0233411 | A1 * | 9/2010 | Flynn et al. | 428/43 |
| 2011/0012419 | A1 * | 1/2011 | Taguchi et al. | 301/5.21 |

* cited by examiner

*Primary Examiner* — Michael Dennis
*Assistant Examiner* — Urszula M Cegielnik

(57) ABSTRACT

Ballast modules for balancing neutrally buoyant or hovering amusement balloons formed from a sheet of transparent weight bearing material having score lines defining a plurality of individual ballast tabs with each of the tabs detachably attached to its adjacent tab by a set of tab ties and having an adhesive layer on one surface of the module for removable attachment to a balloon and a kit including instructions for attaching the ballast to a balloon.

2 Claims, 5 Drawing Sheets

MODULAR BALLAST FOR BALANCING NEUTRALLY BUOYANT AMUSEMENT BALLOONS

CROSS REFERENCE TO RELATED APPLICATIONS

This application claims priority to U.S. Provisional Application Ser. No. 61/576,993; filed on Dec. 17, 2011; titled UNIVERSAL MODULAR BALLAST APPARATUS FOR HELIUM FILLED NEUTRALLY BUOYANT BALLOON ENVELOPES OF VARYING SHAPES AND SIZES.

FIELD OF THE INVENTION

This invention relates to airborne, free-floating untethered hovering balloons and, more specifically to weight balancing tabs for airborne, free-floating untethered hovering balloons and their combination.

STATEMENT REGARDING FEDERALLY SPONSORED RESEARCH OR DEVELOPMENT

None

REFERENCE TO A MICROFICHE APPENDIX

None

BACKGROUND OF THE INVENTION

Airborne, free-floating untethered hovering balloons, sometimes also referred to as Mylar balloons, initially were primarily considered as toys for children. However, they also became of interest to and as amusements for hobbyists. These balloons are made to float or hover in mid-air not tethered by strings or the like, by attaching ballast to the balloon's envelope, see my U.S. Pat. Nos. 4,307,537 and 4,547,167, for example. In general, the user selectively attaches or removes weight-balancing tabs or ballast tabs until the weight of the balloon envelope and the ballast equals the lift of the helium gas contained in the balloon envelope causing the balloon to achieve "neutral buoyancy" so that it hovers in mid-air at a desired height.

Over the years a relatively small number of balloon sizes and shapes became standard. But the increased popularity as a child's toy and as a hobbyist activity has led to the desire for and production of a greater number of different and intricate balloon shapes and sizes. Examples may be, a multiple-pointed star shaped decorated balloon or a replica of a human or an animal which the user may want to make hover at different altitudes and attitudes from time to time. But this has led to a more difficult and somewhat more complicated and arduous scheme or procedure for achieving and maintaining neutral buoyancy and desirable attitude for the balloon. This apparently has adversely affected growth in popularity of the hovering balloon by both children and hobbyist. To offset this I have found that the weight balancing or ballast system must address the many different shapes and sizes of these balloons, which are currently available and those which may evolve in the future. Some shapes require significantly more ballast than others to hover at the desired height or altitude because of their inherent weight and some lose their altitude and/or attitude and list, either initially or if they lose helium over time.

In addition, because of the shapes some balloon can only accommodate long narrow shaped ballast while others might require wider shorter shaped ballast to maintain attitude in flight.

Therefore, the correct size, weight and location of the ballast for each balloon may be significantly different.

In addition, since the ballast is adhesively backed for releasable attachment, because of the wide variety of shapes each balloon may have a different smooth surface available for attaching the ballast. This may affect the size or shape of the ballast that can be attached to the balloon envelope, e.g. a rectangular shape rather than square or circular one may be preferred or necessary.

Furthermore, advances in balloon manufacturing technology has led to the development of a multitude of balloons of different sizes and shapes, many decorated with unique artwork. Also, many present day hovering toy balloons are significantly larger than in the past and so may require heavier and/or larger ballast weight. In addition, some configured balloons may require precisely located weight tabs to retain their proper orientation or attitude and hovering level.

Further, weight tabs or ballast tabs made out of opaque material attached to a balloon may detract from the decorative effect of the artwork on uniquely decorated balloons.

With hovering balloons becoming of greater interest to hobbyists and becoming more complex as designs of shapes and configurations and decorations has become more sophisticated and varied, the art has become more complicated. Therefore, the main object of the instant invention is to provide improvements in the field of hovering balloons, to overcome the problems introduced by the advent of the complexities mentioned above and still retain its basic operation and enjoyment.

BRIEF SUMMARY OF THE INVENTION

As described hereinabove, the intricate and varied sizes and shapes of many hovering balloons may require fairly precise locations and weight of the ballast to keep it afloat at the desired altitude and attitude. In order to make it easier for the user to adjust the weight balance a feature of my invention is a sheet of ballast material, sometimes referred to as a ballast module, having a suitable adhesive coating on one surface and having embedded score lines which divide the sheet into a multiplicity of individual and equally-sized tabs, generally referred to as weight tabs or ballast tabs. Each tab is attached to its adjacent tab at the score line by at least one tab tie so that it is removable or detachable from its adjacent tab. This permits the ballast tabs to be removed from the module individually or in strips or blocks and be adhesively attached to the balloon as required for various shapes and sizes of balloons.

As an added feature, the ballast is made of a transparent material so that when attached to a balloon it does not detract from any decoration. Naturally the material must have sufficient weight to serve as adequate ballast.

A further feature of the invention is providing guidelines or markings on the outer skin of the balloon as to where it is preferable to place the ballast to ensure that the balloon will achieve neutral buoyancy so that it will float or hover at the desired altitude and attitude.

In accordance with the teachings of the instant invention of providing a ballast module and material as described along with suitable guide lines on the balloons, it is a further feature of the invention to provide instructions where necessary for applying the ballast onto uniquely shaped or configured balloons to avoid the "hit- and-miss" efforts of the past and thereby make the hovering amusement balloon more popular with children and hobbyists.

DESCRIPTION OF THE PREFERRED EMBODIMENT

Figure 1:
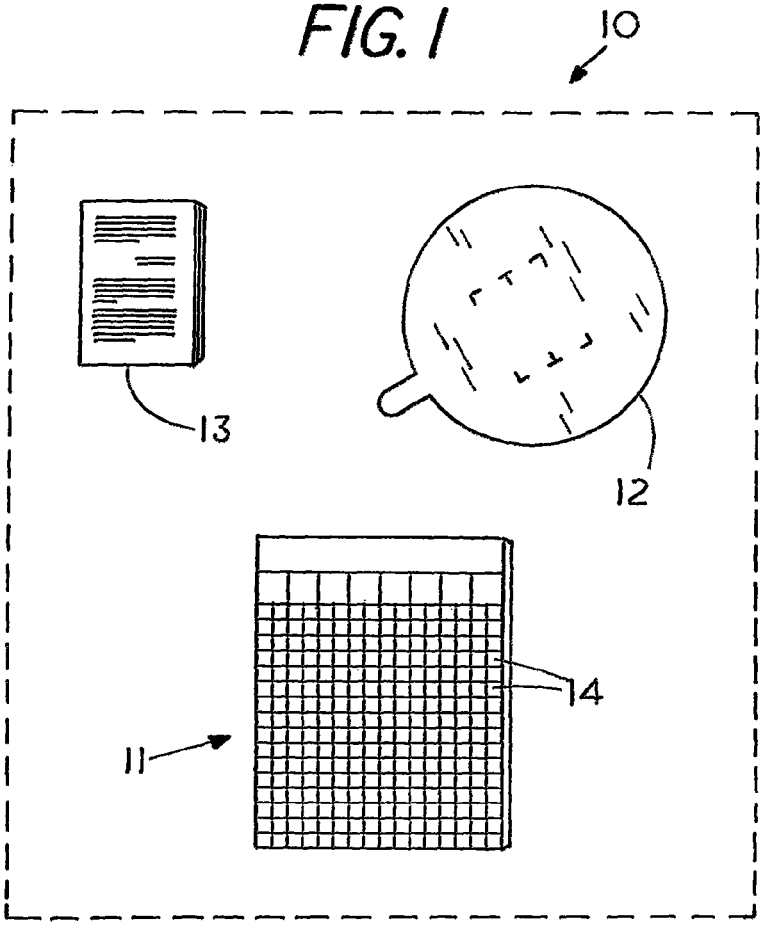
FIG. 1 shows the individual parts making up a kit for a free-floating, hovering, untethered amusement balloon.

Referring now specifically to the drawings, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art.

FIG. 1 shows the individual parts making up an embodiment of the present invention comprising a kit 10 for a free-floating, hovering, untethered amusement balloon. Kit 10 generally includes a ballast module 11, an un-inflated amusement balloon 12, and a set of instructions 13.

In specific regards to ballast module 11, a ballast module 11 generally comprises a sheet of weight bearing material, preferably about 8 to 20 mils in thickness, preferably weighing 4 to 10 grams, preferably a transparent material and more preferably a transparent plastic material, and most preferably a tear resistant transparent plastic material, having intersecting score lines defining a multiplicity of individual ballast tabs 14. Ballast module 11 also includes an adhesive layer 15 located on one surface of the ballast module 11 for removably attaching the tab(s) to the amusement balloon 12, usually, but not always after it is inflated.

Figure 2:
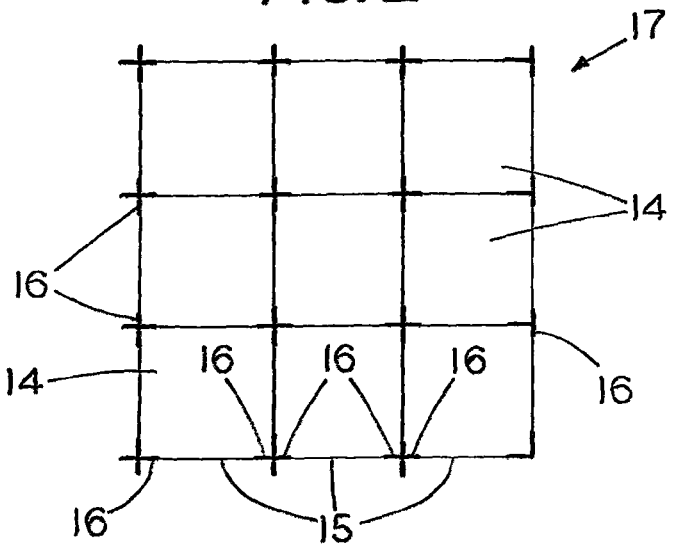
FIG. 2 shows ballast tabs severably attached to its adjacent tabs by a tab tie located between a set of perforations, which define the score lines.

Referring to FIGS. 2-6, each of the tabs 14 are severably attached to its adjacent tab 14 by tab tie(s) whereby the tabs 14 are removable from the ballast module 11 individually and in groups. FIG. 2 specifically shows a portion of a ballast module 17 with each tabs 14 severably attached to its adjacent tab 14 by a tab tie 15 and located between perforations 16, which define the score lines. Each of the tabs 14 are scored so that the tab can be divided into any size or shape. As shown in FIG. 2 the perforations 16 are formed in a manner to allow the removal of a single tab 14 or a succession of interconnecting tabs 14 that can be removed in any direction or divided into hundreds of different configurations solid blocks or modules of any size.

Figure 3:
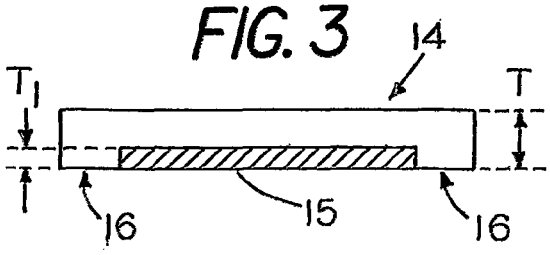
FIG. 3 is a cross-sectional view of a score line of FIG. 2.

FIG. 3 is a cross-sectional view of a score line of one of the tabs 14 of FIG. 2. As shown in FIG. 3 tabs 14 has a tab width "T" with perforations 16 being cut completely through tab width "T". Tab ties 15 are each cut partially into tab width "T" to form a tab tie width "T1" to enable tab ties 14 to tear easier along the score lines yet is strong enough to allow the next or adjacent tab 14 to tear off in a continuous strip while still allowing for their attachment to each other in the unused or post manufactured form. For example, tab tie thickness "T1" may comprise a thickness that is ½ to ¼ the thickness of tab width "T".

Figure 4:
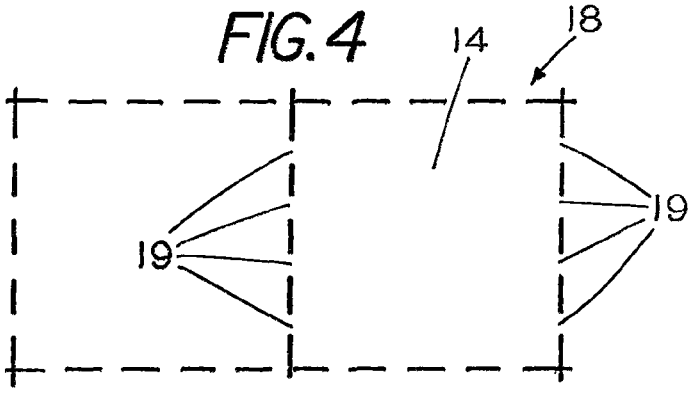
FIG. 4 shows a portion of a ballast module having a plurality of individual ballast tabs with each of the tabs detachably attached to its adjacent tab by a set of 4 (four) tab ties.
Figure 5:
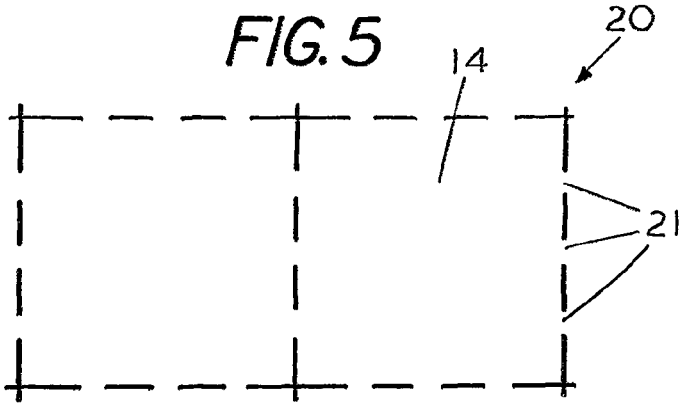
FIG. 5 shows a portion a ballast module having a plurality of individual ballast tabs with each of the tabs detachably attached to its adjacent tab by a set of 3 (three) tab ties.
Figure 6:
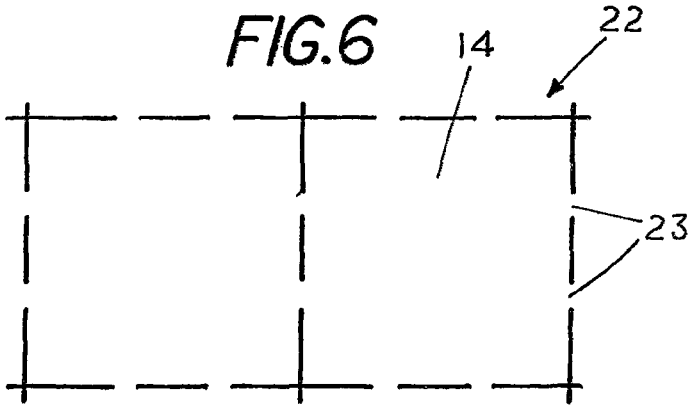
FIG. 6 shows a portion a ballast module having a plurality of individual ballast tabs with each of the tabs detachably attached to its adjacent tab by a set of 2 (two) tab ties.

Referring to FIGS. 4-6, FIG. 4 shows a portion of a ballast module 18 having a plurality of individual ballast tabs 14 with each of the tabs 14 detachably attached to its adjacent tab 14 by a set of 4 (four) tab ties 19. FIG. 5 shows a portion of a ballast module 20 having a plurality of individual ballast tabs 14 with each of the tabs 14 detachably attached to its adjacent tab 14 by a set of 3 (three) tab ties 21. FIG. 6 shows a portion of a ballast module 22 having a plurality of individual ballast tabs 14 with each of the tabs 14 detachably attached to its adjacent tab 14 by a set of 2 (two) tab ties 23.

Figure 7:
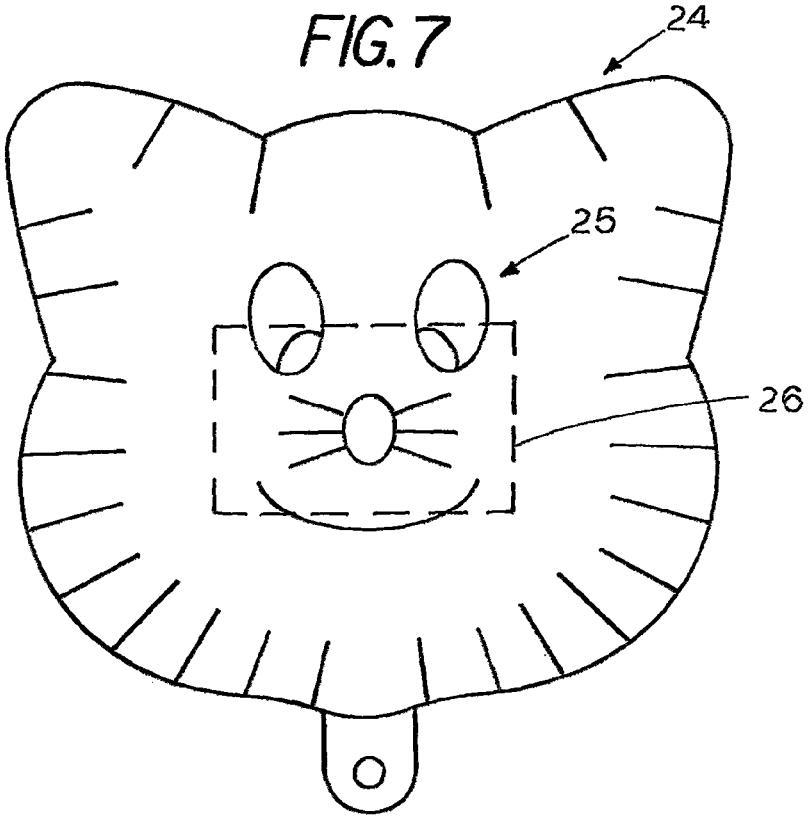
FIG. 7 is a front view of an amusement balloon having a cat's face design located thereon and a plurality of transparent ballast tabs attached over a portion of the design.

FIG. 7 is a front or plan view of a somewhat complex amusement balloon 24 configured in the shape of a cat's head and having a cat's face design 25 located on the outer surface of amusement balloon 24. Amusement balloon 24 is shown including a plurality of transparent ballast tabs 26 attached over a portion of design 25. The transparency or transparent feature of ballast tabs 26 allows amusement balloon 24 to maintain the decorative effect of design 25 while enabling amusement balloon 24 to free-float, hover, untethered at a desired altitude and attitude.

Figure 8:
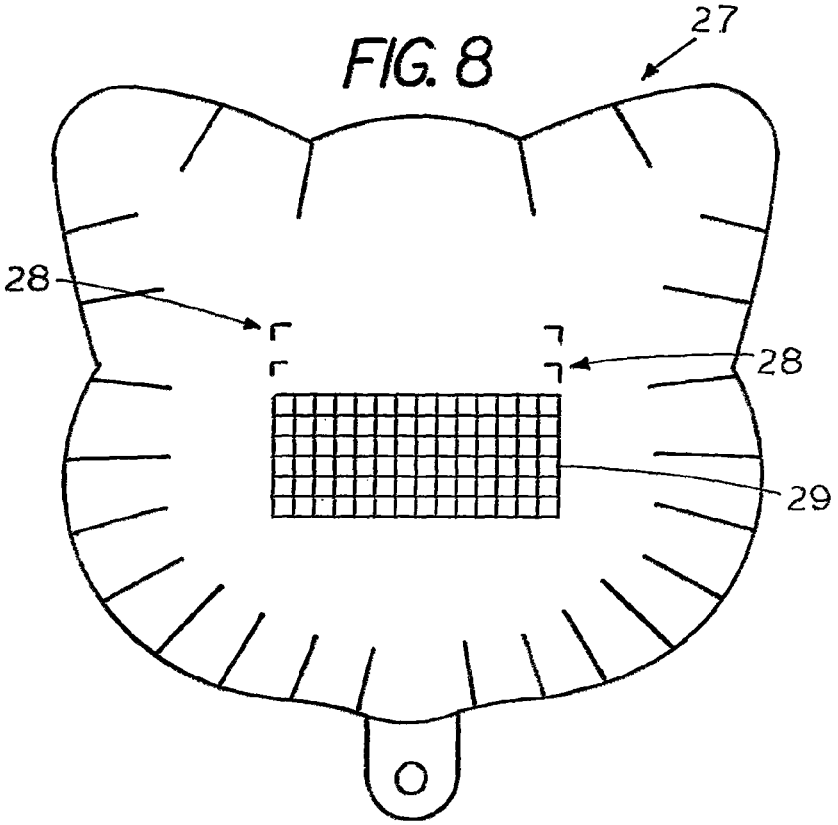
FIG. 8 is a front view of another cat face amusement balloon having tab placement guide markings located thereon and ballast tabs attached over a portion of the guide markings.
Figure 8A:
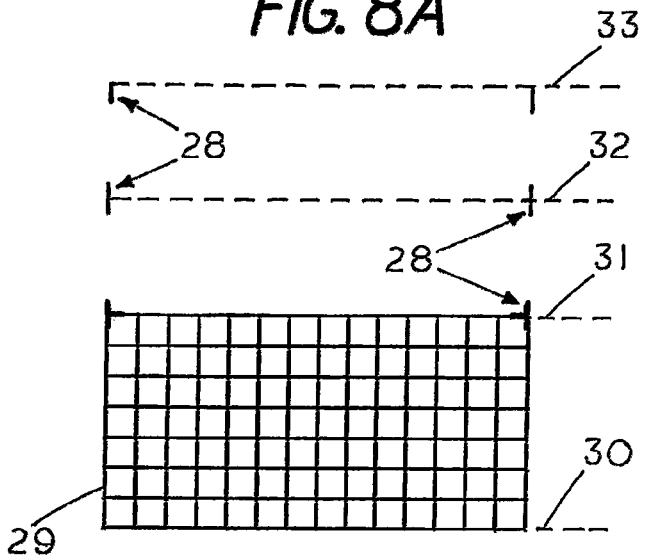
FIG. 8A is a close-up view of the tab placement guide markings and ballast tabs of FIG. 8.

FIG. 8 is a front or plan view of another amusement balloon 27 in the shape of a cat's head and having tab placement guide markings 28 located on the outer surface of amusement balloon 27. Amusement balloon 27 is shown including a plurality of ballast tabs 29 attached over a portion of tab placement guide markings 28. FIG. 8A is a close-up enlarged view of the tab placement guide markings 28 and ballast tabs 29 of FIG. 8.

Typically, for example, tab placement guide markings 28 may provide the user with general instructions on where on amusement balloon 27 to attach ballast tabs 29 to achieve proper balance and also general instructions on the number or amount of ballast tabs 29 to attach to amusement balloon 27 to enable amusement balloon 27 to free-float, hover and untethered. This can be very helpful for users where the altitude can be quite different at different locations depending on sea level.

For example, referring to FIG. 8A, at locations 4,000 feet above sea level, the user would approximately attach enough ballast tabs 29 to cover or fill between tab placement guide markings 28 from a baseline 30 to a tier 1 identified by reference numeral 31. At locations 2,000 feet above sea level, the user would approximately attach enough ballast tabs 29 to cover or fill between tab placement guide markings 28 from baseline 30 to a tier 2 identified by reference numeral 32 and at locations generally at sea level, the user would approximately attach enough ballast tabs 29 to cover or fill between tab placement guide markings 28 from baseline 30 to a tier 3 identified by reference numeral 33.

Figure 9:
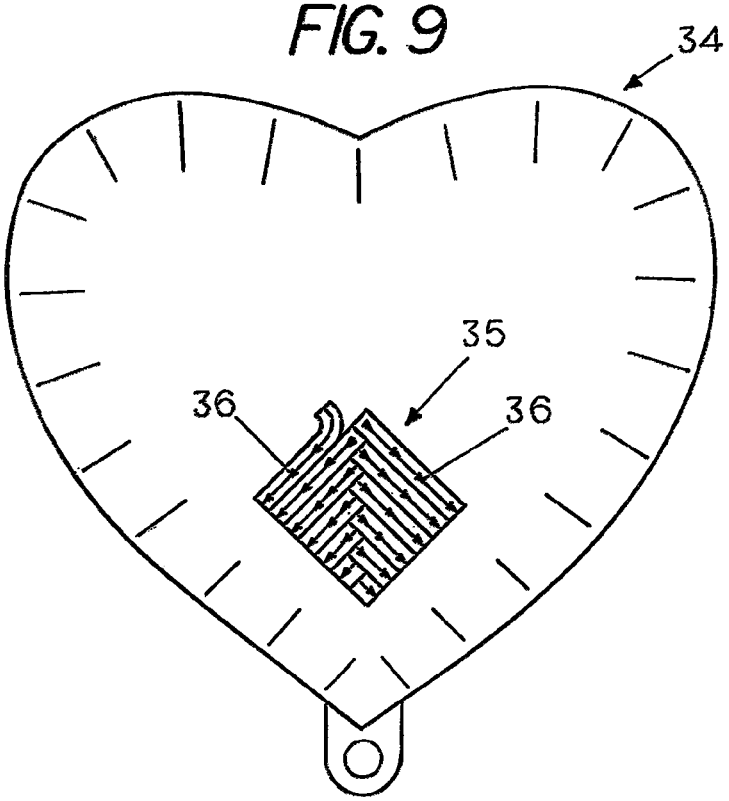
FIG. 9 is a front view of an amusement balloon having ballast tabs containing removal instructions printed thereon attached over a portion of the amusement balloon.

FIG. 9 is a front view of an amusement balloon 34 in the shape of a heart and having a plurality of ballast tabs 35 attached over a portion of an exterior surface of amusement balloon 34. A feature of the embodiment of FIG. 9 is that plurality of ballast tabs 35 includes instructions in the form of arrows 36 directly printed thereon as to where and how to remove a plurality of ballast tabs 35 from amusement balloon 34 if necessary to achieve proper balance and desired altitude.

Figure 10:
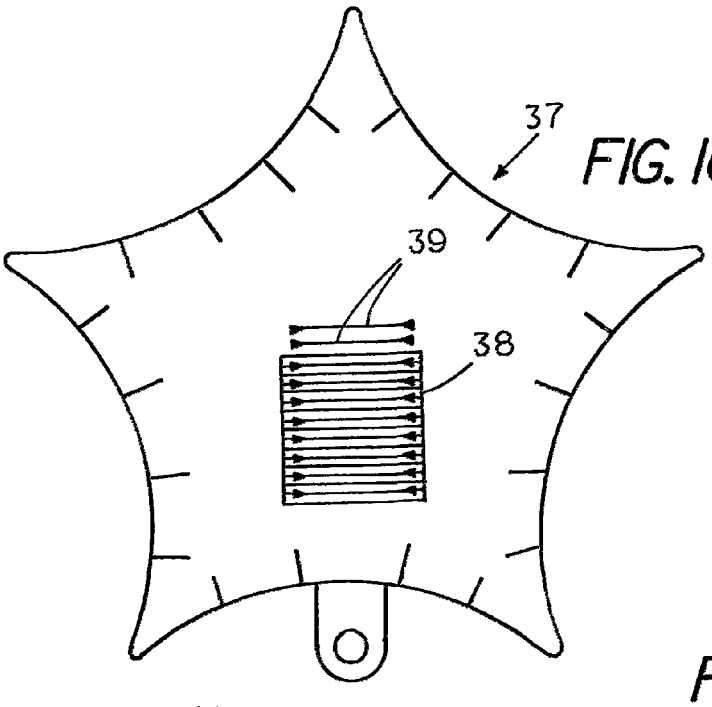
FIG. 10 is a front view of an amusement balloon having tab instructions directly printed on the amusement balloon and transparent ballast tabs attached over the instructions.

FIG. 10 is a front view of an amusement balloon 37 in the shape of a star. Amusement balloon 37 includes a plurality of transparent ballast tabs 38 attached directly over a portion of an exterior surface of amusement balloon 37 supporting instructions 39, which are directly printed on amusement balloon 37. The transparency or transparent feature of ballast tabs 38 allows instructions 39 to be viewable by the user through ballast tabs 38. A feature of the embodiment of FIG. 10 is the instructions 39 not only provide the user with general instructions as to where to place tabs on amusement balloon 37 but also the amount of ballast tabs 38 to attach to amusement balloon 37 to achieve proper balance. Also general instructions are provided as to where and how to remove the ballast tabs 35 from amusement balloon 37 to readjust the desired altitude and attitude that amusement balloon 37 can free-floats or hover in an untethered condition.

Figure 11:
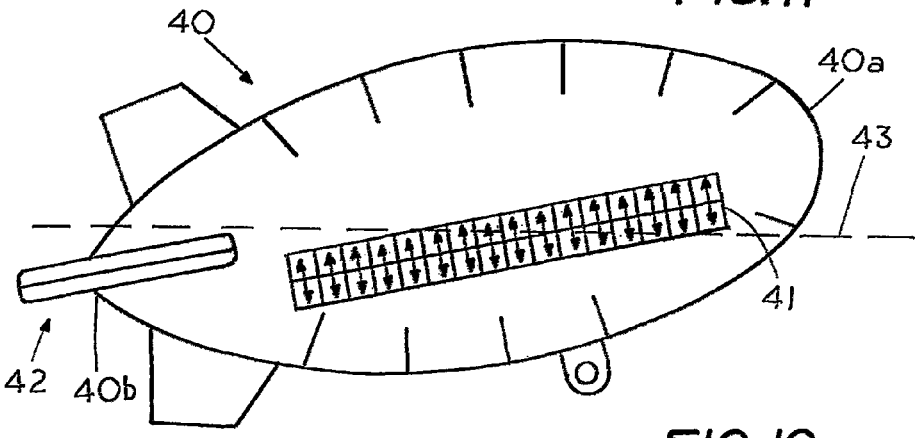
FIG. 11 is a side views showing a blimp shaped amusement balloon tilted due to an uneven distribution of weight resulting from the presence of a tail portion.
Figure 12:
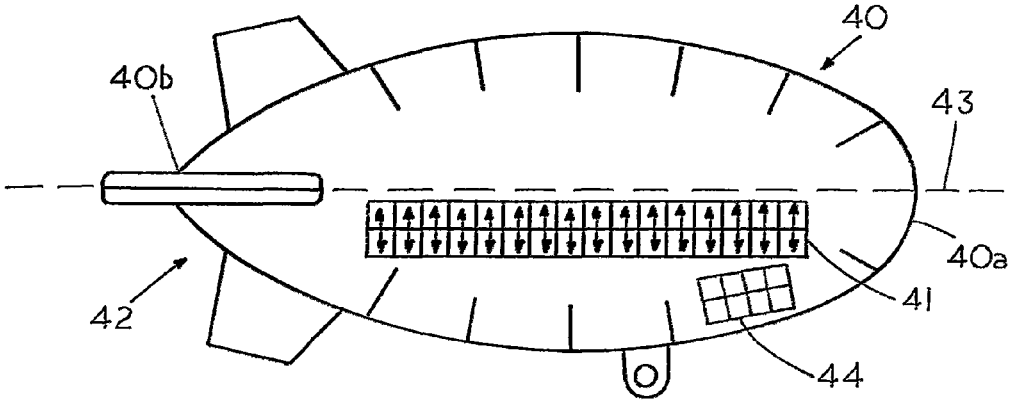
FIG. 12 shows the blimp shaped amusement balloon of FIG. 11 in a leveled condition due to the addition of counter balance/quick control ballast tabs.

FIGS. 11 and 12 are side views showing an amusement balloon 40 in the shape of a blimp having a first end 40*a* and a second end 40*b* and having a plurality of ballast tabs 41 attached over a portion of an exterior surface of amusement balloon 40. The design of amusement balloon 40 includes a tail portion 42 located proximal second end 40*b* of amusement balloon 40. As shown in FIG. 11, the presence of portion 42 adds addition weight proximal the second end 40*b* of amusement balloon 40 compared to the first end 40*b* of amusement balloon 40 causing amusement balloon 40 to list or tilt undesirably. That is, the first end 40*a* of amusement balloon 40 is shown with excessive lift above a horizontal axis 43 and the second end 40*b* of amusement balloon 40 is shown dipping below horizontal axis 43.

To combat the undesirable list or tilting effect of the amusement balloon 40 due to an uneven distribution of weight resulting from the presence of tail portion 42, FIG. 12 shows amusement balloon 40 including counter balance/quick control ballast tabs 44 located on an area of amusement balloon 40 that requires additional weight to level amusement balloon 40 with respect to horizontal axis 43 and eliminate the undesirable list or tilt. Counter balance/quick control ballast tabs 44 may also be used by incrementally moving counter balance/quick control ballast tabs 44 on amusement balloon 40 as the balloon loses Helium to maintain a desired attitude.

I claim:

1. Ballast for a hovering amusement balloon, comprising: a hovering amusement balloon ballast module, said hovering amusement balloon ballast module comprising a tear resistant sheet of weight bearing material having at least a weight to achieve "neutral buoyancy" of a hovering amusement balloon fully filled with helium gas; said sheet of weight bearing material including intersecting score lines defining a multiplicity of at least 9 individual hovering amusement balloon ballast tabs each of said hovering amusement balloon ballast tabs directly and detachably attached to its adjacent tab by at least one tab tie formed from the same material as said ballast tabs, tab ties are each cut partially into tab width to enable tab ties to tear easier along the score lines yet strong enough to allow the next or adjacent tabs to tear off in a continuous strip allowing for their attachment to each other in the unused or post manufactured form, said tab ties allow for the application or removal in any direction from said hovering amusement balloon ballast of a single ballast tab or the application or removal of a succession or series of sequentially connected ballast tabs in a continuous row or groups of rows or blocks of tabs; said tab ties allowing said sheet of weight bearing material to be divided into a multiplicity of different interconnected tab module configurations that can be used alone or in combination with at least one other of said tab module configurations on said Helium filled amusement balloon; and an adhesive layer supported on an amusement balloon engaging surface of said hovering amusement balloon ballast module for releasable attachment directly to a surface or surfaces of a hovering amusement balloon.

2. The ballast for a hovering amusement balloon as described in claim 1 wherein one or more of said ballast tab configurations are adhesively attached to said hovering amusement balloon to achieve a desired initial balance attitude and then incrementally repositioned to maintain a desired attitude over time as said attitude changes to to user preference or Helium loss.

* * * * *